US008732895B2

(12) United States Patent
Cunningham

(10) Patent No.: US 8,732,895 B2
(45) Date of Patent: May 27, 2014

(54) CENTRAL VACUUM CLEANER MULTIPLE VACUUM SOURCE CONTROL

(75) Inventor: J. Vern Cunningham, Aurora (CA)

(73) Assignee: Cube Investments Limited, Aurora (CA)

( * ) Notice: Subject to any disclaimer, the term of this patent is extended or adjusted under 35 U.S.C. 154(b) by 1206 days.

(21) Appl. No.: 11/543,949

(22) Filed: Oct. 6, 2006

(65) Prior Publication Data

US 2007/0079466 A1 Apr. 12, 2007

Related U.S. Application Data

(60) Provisional application No. 60/724,289, filed on Oct. 7, 2005.

(51) Int. Cl.
*A47L 5/38* (2006.01)

(52) U.S. Cl.
USPC ..... 15/314

(58) Field of Classification Search
USPC ..... 15/314, 315, 319, 326, 327.6, 331, 339, 15/353
See application file for complete search history.

(56) References Cited

U.S. PATENT DOCUMENTS

| | | | |
|---|---|---|---|
| 1,601,531 | A | 9/1926 | Jeannin |
| 1,883,288 | A | 10/1932 | Zubaty |
| 3,088,484 | A | 5/1963 | Marsh |
| 3,357,039 | A | 12/1967 | Hayward |
| 3,382,524 | A | 5/1968 | Sandstrom |
| 3,477,689 | A | 11/1969 | Berghoefer |
| 3,483,503 | A | 12/1969 | Pardiso |
| 3,565,103 | A | 2/1971 | Maselek |
| 3,570,809 | A | 3/1971 | Stuy |
| 3,626,545 | A | 12/1971 | Sparrow |
| 3,628,769 | A | 12/1971 | Lee |
| 3,661,356 | A | 5/1972 | Tucker |
| 3,663,845 | A | 5/1972 | Apstein |
| 3,676,986 | A | 7/1972 | Reiling |
| 3,826,464 | A | 7/1974 | Berghofer |
| 3,855,665 | A | 12/1974 | Schwartz |
| 3,965,526 | A | 6/1976 | Doubleday |
| 3,989,311 | A | 11/1976 | Debrey |
| 4,056,334 | A | 11/1977 | Fortune |

(Continued)

FOREIGN PATENT DOCUMENTS

| | | |
|---|---|---|
| EP | 0192469 | 8/1986 |
| EP | 0347223 | 12/1989 |

(Continued)

OTHER PUBLICATIONS

Heritage Central Vacuum, Crush Proof Hoses Non-Electric, http://www.heritagevac.com/hosesnonelectric.html, printed Sep. 21, 2005, pp. 4, Azusa, USA.

(Continued)

*Primary Examiner* — Robert Scruggs

(57) ABSTRACT

A central vacuum cleaning system has multiple vacuum sources. The multiple vacuum sources are connected through pipes to wall valves. In use a hose is plugged into one of the valves. A handle is connected to the hose. A wand extends from the handle. Attachments such as a power brush are connected to the wand. Switches apply power from one or more power sources to the vacuum sources. The application of power by the switches is controlled by a control circuit.

10 Claims, 4 Drawing Sheets

(56) References Cited

U.S. PATENT DOCUMENTS 4,070,586 A 1/1978 Breslin
4,111,615 A 9/1978 Watanabe
4,114,557 A 9/1978 De Brey
4,175,892 A 11/1979 De brey
4,225,272 A 9/1980 Palmovist
4,227,258 A 10/1980 Root et al.
4,246,675 A 1/1981 Costanzo
4,300,262 A 11/1981 Rodowsky, Jr. et al.
4,336,427 A 6/1982 Lindsay
4,368,348 A 1/1983 Eichelberger et al.
4,369,543 A 1/1983 Chen et al.
4,370,776 A 2/1983 Kullik
4,443,906 A * 4/1984 Tucker et al. ..... 15/50.1
4,473,923 A 10/1984 Neroni et al.
4,490,575 A 12/1984 Kutnyak
4,494,270 A 1/1985 Ritzau et al.
4,513,469 A 4/1985 Godfrey et al.
4,531,796 A 7/1985 Gansert et al.
4,536,674 A 8/1985 Schmidt
4,591,368 A 5/1986 MacDuff
4,611,365 A 9/1986 Komatsu et al.
4,654,924 A 4/1987 Getz et al.
4,664,457 A 5/1987 Suchy
4,680,827 A 7/1987 Hummel
4,683,515 A 7/1987 Beihoff et al.
4,688,596 A 8/1987 Liebmann et al.
4,693,324 A 9/1987 Choiniere et al.
4,731,545 A 3/1988 Lerner et al.
4,757,574 A 7/1988 Sumerau
4,766,628 A 8/1988 Walker
4,791,700 A 12/1988 Bigley et al.
4,829,625 A 5/1989 Wang
4,829,626 A 5/1989 Harkonen et al.
4,854,887 A 8/1989 Blandin
4,881,909 A 11/1989 Blackman
4,883,982 A 11/1989 Forbes et al.
4,938,309 A * 7/1990 Emdy ..... 181/231
D315,043 S 2/1991 Hayden
4,991,253 A 2/1991 Rechstiner
5,033,151 A 7/1991 Kraft et al.
5,067,394 A 11/1991 Cavallero
5,068,555 A 11/1991 Oberdorfer-Bogel
5,107,565 A 4/1992 Chun
5,109,568 A 5/1992 Rohn et al.
5,111,841 A 5/1992 Houston
5,120,983 A 6/1992 Samaan
5,125,125 A * 6/1992 Barsacq ..... 15/314
D333,023 S 2/1993 Herron, Jr.
5,185,705 A 2/1993 Farrington
D334,447 S 3/1993 Rohn
5,191,673 A 3/1993 Damizet
5,207,498 A 5/1993 Lawrence et al.
5,244,409 A 9/1993 Guss et al.
5,255,409 A 10/1993 Fujiwara et al.
5,263,502 A 11/1993 Dick
5,265,305 A 11/1993 Kraft et al.
5,274,578 A 12/1993 Noeth
5,274,878 A 1/1994 Radabaugh et al.
5,276,434 A 1/1994 Brooks et al.
5,276,939 A 1/1994 Uenishi
5,277,468 A 1/1994 Blatt et al.
5,298,821 A 3/1994 Michel
5,301,385 A 4/1994 Abe et al.
5,311,639 A 5/1994 Boshler
5,343,590 A 9/1994 Radabaugh
5,347,186 A 9/1994 Konotchick
5,349,146 A 9/1994 Radabaugh
5,353,468 A 10/1994 Yap et al.
5,363,534 A 11/1994 Dekker et al.
5,379,796 A 1/1995 Wang
5,391,064 A 2/1995 Lopez
5,404,612 A 4/1995 Ishikawa
5,409,398 A 4/1995 Chadbourne et al.
5,448,827 A 9/1995 Ward
D364,014 S 11/1995 Langeland et al.
5,479,676 A 1/1996 Martin et al.
5,504,971 A 4/1996 McCormick
5,512,883 A 4/1996 Lane, Jr.
5,515,572 A 5/1996 Hoeksra et al.
5,525,842 A 6/1996 Leininger
5,542,146 A 8/1996 Hoekstra et al.
5,554,049 A 9/1996 Reynolds
5,560,076 A 10/1996 Leung
5,568,374 A 10/1996 Lindeboom et al.
5,572,767 A 11/1996 Ishikawa
5,578,795 A 11/1996 Ward
5,606,767 A 3/1997 Crienjak et al.
5,655,884 A 8/1997 Rose
5,698,957 A 12/1997 Sowada
5,713,656 A 2/1998 Lin
5,722,110 A 3/1998 McIntyre et al.
5,737,797 A 4/1998 Rittmueller et al.
5,737,798 A 4/1998 Moren et al.
5,740,581 A 4/1998 Harrelson, II
5,740,582 A 4/1998 Harrelson, II
5,747,973 A 5/1998 Robitaille et al.
5,753,989 A 5/1998 Syverson et al.
5,813,085 A 9/1998 Fritz et al.
5,815,883 A 10/1998 Stein et al.
5,815,884 A 10/1998 Imamura
5,816,685 A 10/1998 Hou
5,850,665 A 12/1998 Bousset
5,871,152 A 2/1999 Saney
D406,422 S 3/1999 Burchard et al.
5,893,194 A * 4/1999 Karmel ..... 15/314
5,896,618 A 4/1999 Woo et al.
5,917,428 A 6/1999 Discenzo et al.
5,918,728 A 7/1999 Syverson
5,924,163 A 7/1999 Burns, Jr.
5,924,164 A 7/1999 Lindsay, Jr.
5,926,908 A 7/1999 Lindsay, Jr.
5,926,909 A 7/1999 McGee
5,938,061 A 8/1999 Ward et al.
5,945,749 A 8/1999 Li
5,983,443 A 11/1999 Redding
5,987,697 A 11/1999 Song et al.
6,011,334 A 1/2000 Roland
6,029,309 A 2/2000 Imamura
6,033,082 A 3/2000 Lin
6,049,143 A 4/2000 Simpson et al.
6,101,667 A 8/2000 Ishikawa
D431,335 S 9/2000 Mehaffey et al.
6,169,258 B1 1/2001 Roney et al.
6,206,181 B1 3/2001 Syverson
6,218,798 B1 4/2001 Price et al.
6,232,696 B1 5/2001 Kim et al.
6,239,576 B1 * 5/2001 Breslin et al. ..... 318/805
6,244,427 B1 6/2001 Syverson
6,253,414 B1 7/2001 Bradd et al.
6,256,833 B1 7/2001 Steinberg
6,323,570 B1 11/2001 Nishimura et al.
6,336,825 B1 1/2002 Seefried
6,425,293 B1 7/2002 Woodroffe et al.
6,459,056 B1 10/2002 Graham
6,463,368 B1 10/2002 Feiten et al.
6,488,475 B2 12/2002 Murata et al.
6,546,814 B1 4/2003 Choe et al.
6,628,019 B2 9/2003 Carroll
6,658,325 B2 12/2003 Zweig
6,685,491 B2 2/2004 Gergek
6,690,804 B2 2/2004 Everett
D494,332 S 8/2004 Schroeter
D494,333 S 8/2004 Schroeter
6,779,228 B2 8/2004 Plomteux et al.
6,791,205 B2 9/2004 Woodbridge
6,817,058 B1 11/2004 Harrelson, II
6,822,353 B2 11/2004 Koga et al.
6,864,594 B2 3/2005 Seki
6,900,565 B2 5/2005 Preston
6,975,043 B2 12/2005 Schumacher et al.
6,975,993 B1 12/2005 Lin
7,051,398 B2 5/2006 Smith et al.
7,080,425 B2 7/2006 Smith et al.
7,114,216 B2 10/2006 Stephens et al.

(56) References Cited

U.S. PATENT DOCUMENTS

| | | | | |
|---|---|---|---|---|
| 7,122,921 | B2 | 10/2006 | Hall et al. | |
| 7,237,298 | B2 | 7/2007 | Reindle et al. | |
| 7,269,877 | B2 | 9/2007 | Tondra et al. | |
| 7,328,479 | B2 | 2/2008 | Willenbring | |
| 7,331,083 | B2 | 2/2008 | Overvaag et al. | |
| 7,342,372 | B2 | 3/2008 | Jonsson et al. | |
| 7,363,679 | B2 | 4/2008 | Zimmerle et al. | |
| 7,403,360 | B2 | 7/2008 | Cunningham et al. | |
| 7,406,744 | B2 | 8/2008 | Bruneau | |
| 2002/0001190 | A1 | 1/2002 | Everett | |
| 2002/0127916 | A1 | 9/2002 | Zhang | |
| 2002/0152576 | A1 | 10/2002 | Murray et al. | |
| 2003/0044243 | A1* | 3/2003 | Tisdale | 406/28 |
| 2003/0140443 | A1 | 7/2003 | Najm | |
| 2003/0196293 | A1 | 10/2003 | Ruff | |
| 2004/0031506 | A1 | 2/2004 | Tsai | |
| 2004/0049868 | A1 | 3/2004 | Ng | |
| 2004/0135537 | A1* | 7/2004 | Conner et al. | 318/701 |
| 2004/0144633 | A1 | 7/2004 | Gordon et al. | |
| 2004/0150271 | A1 | 8/2004 | Koga et al. | |
| 2004/0172782 | A1* | 9/2004 | Smith et al. | 15/314 |
| 2004/0177468 | A1 | 9/2004 | Smith et al. | |
| 2004/0231090 | A1* | 11/2004 | Kushida et al. | 15/326 |
| 2004/0261211 | A1 | 12/2004 | Overvaag et al. | |
| 2005/0022329 | A1 | 2/2005 | Harman et al. | |
| 2005/0022337 | A1 | 2/2005 | Roney et al. | |
| 2005/0055795 | A1* | 3/2005 | Zeiler et al. | 15/353 |
| 2005/0166351 | A1 | 8/2005 | Cunningham et al. | |
| 2005/0236012 | A1 | 10/2005 | Josefsson et al. | |
| 2005/0245194 | A1 | 11/2005 | Hayes et al. | |
| 2005/0254185 | A1 | 11/2005 | Cunningham | |
| 2007/0283521 | A1 | 12/2007 | Foster et al. | |
| 2008/0066252 | A1 | 3/2008 | Herron, Jr. | |
| 2008/0222836 | A1 | 9/2008 | Cunningham | |
| 2008/0301903 | A1 | 12/2008 | Cunningham et al. | |

FOREIGN PATENT DOCUMENTS

| | | |
|---|---|---|
| EP | 0552978 | 7/1993 |
| EP | 0499235 | 9/1995 |
| EP | 0711023 | 5/1996 |
| EP | 0773619 | 5/1997 |
| GB | 2281507 | 3/1995 |
| GB | 2288115 | 10/1995 |
| JP | 53-58160 | 5/1978 |
| JP | 53-128158 | 11/1978 |
| JP | 60-26494 | 9/1985 |
| JP | 64-049526 | 2/1989 |
| JP | 2-152420 | 6/1990 |
| JP | 2-152419 | 12/1990 |
| JP | 4-017830 | 1/1992 |
| JP | 5-003839 | 1/1993 |
| JP | 5-317213 | 3/1993 |
| JP | 6-277167 | 10/1994 |
| JP | 7-095944 | 11/1995 |
| JP | 7-322980 | 12/1995 |
| JP | 8-033596 | 2/1996 |
| JP | 8-117165 | 5/1996 |
| JP | 8-065876 | 8/1996 |
| JP | 8-240329 | 9/1996 |
| JP | 9-149871 | 10/1997 |
| JP | 10-094504 | 4/1998 |
| JP | 2000-116577 | 4/2000 |
| JP | 2001-137158 | 5/2001 |
| JP | 2002-078656 | 3/2002 |
| JP | 2002-320577 | 5/2002 |
| JP | 2003-235767 | 8/2003 |
| JP | 2005-102465 | 4/2005 |
| JP | 2009-058919 | 3/2009 |
| WO | 97/37423 | 10/1997 |
| WO | 97/41631 | 11/1997 |
| WO | 98/35160 | 8/1998 |
| WO | 99/09875 | 3/1999 |
| WO | 99/56606 | 11/1999 |
| WO | 00/64323 | 11/2000 |
| WO | 2005/031169 | 2/2005 |
| WO | 2007/017057 | 2/2007 |

OTHER PUBLICATIONS

New Central Vacuum Breaks Home Automation Barrier, Business Wire dated Feb. 26, 2002.

Ultimate Air Inc., The UltimateAir RecoupAerator 200DX Energy Recovery Ventilator, Owner's Manual and Installation Guide, Jan. 24, 2006, pp. i-iv, 1-41Athens, USA.

* cited by examiner

CENTRAL VACUUM CLEANER MULTIPLE VACUUM SOURCE CONTROL

This application claims priority from, and is entitled to the benefit of the filing date of, U.S. patent application Ser. No. 60/724,289 entitled CENTRAL VACUUM CLEANER MULTIPLE VACUUM SOURCE CONTROL filed 7 Oct. 2005, the content of which is hereby incorporated by reference into the detailed description hereof.

FIELD OF THE INVENTION

The invention relates to central vacuum cleaning systems.

BACKGROUND OF THE INVENTION

Central vacuum cleaning systems were originally quite simple. One placed a powerful central vacuum source external to the main living space. The source was connected through interior walls to a long flexible hose that terminated in a handle and nozzle. When an operator desired to use the system, the operator went to the source and turned it on. The operator then went inside, picked up the handle and directed the nozzle to an area to be cleaned.

Although many elements of the basic system remain, many improvements have been made. Rigid pipes typically run inside interior walls to numerous wall valves spaced throughout a building. This allows an operator to utilize a smaller hose while covering an equivalent space. This is an advantage as the hose can be quite bulky and heavy.

Various communication systems have been developed. Some systems sense sound or pressure in the pipes to turn the vacuum source on or off, see for example U.S. Pat. No. 5,924,164 issued 20 Jul. 1999 to Edward W. Lindsay under title ACOUSTIC COMMUNICATOR FOR CENTRAL VACUUM CLEANERS. Other systems run low voltage wires between the source and the wall valve. The source can be turned on and off at a wall valve by a switch that may be activated by insertion or removal of the hose. The hose may also contain low voltage wires to allow the source to be controlled from a switch in the handle, see for example U.S. Pat. No. 5,343,590 issued 6 Sep. 1994 to Kurtis R. Radabaugh under title LOW VOLTAGE CENTRAL VACUUM CONTROL HANDLE WITH AN AIR FLOW SENSOR. The switch can be a simple toggle switch, or a more sophisticated capacitive switch.

The low voltage wires running along the pipes can be replaced by conductive tape or the like on the pipes, see for example U.S. Pat. No. 4,854,887 issued 8 Aug. 1989 to Jean-Claude Blandin under title PIPE SYSTEM FOR CENTRAL SUCTION CLEANING INSTALLATION. Separate low voltage conductors in the walls can be avoided altogether by using mains power wires to transmit communication signals between the wall valve and the source, see for example U.S. Pat. No. 5,274,878 issued 4 Jan. 1994 to Kurtis R. Radabaugh, et al. under title REMOTE CONTROL SYSTEM FOR CENTRAL VACUUM SYSTEMS. A handheld radio frequency wireless transmitter can be used by an operator to turn the source on or off, see for example U.S. Pat. No. 3,626,545 issued 14 Dec. 1971 to Perry W. Sparrow under title CENTRAL VACUUM CLEANER WITH REMOTE CONTROL.

Line voltage can be brought adjacent the vacuum wall valves and connected to the handle through separate conductors, or integrated spiral wound conductors on the hose. Line voltage can then be brought from the handle to powered accessories, such as an electrically-powered beater bar, connected to the nozzle. Line voltage can be switched on and off to the powered accessory using the same switch in the handle that controls the source. Alternatively, the powered accessory may have its own power switch.

A control module mounted to the central vacuum unit is typically used to control the vacuum source. In an effort to increase suction, it is known to utilize two motors in a central vacuum unit under the control of the control module.

Improvements to, or additional or alternative features for, central vacuum cleaning systems are desirable.

SUMMARY OF THE INVENTION

In a first aspect, the invention provides a central vacuum cleaning system including a plurality of vacuum sources, a control circuit, and a plurality of switches. Each switch is associated with a respective one of the vacuum sources. The control circuit is adapted to control the switches. Each switch is adapted to apply power to its associated vacuum source in accordance with control from the control circuit.

The control circuit may be a plurality of control circuits with each control circuit associated with a respective one of the vacuum sources and one of the control circuits adapted to act as a master control circuit while the remaining control circuits are adapted to act as slave control circuits such that each slave control circuit is adapted to control its associated switch under control of the master control circuit.

Each switch may be a continuously variable control switch that is able to apply a continuously variable amount of power. Each switch may include a triac. Each switch may be mounted on a distinct heat sink. Each switch and the vacuum source with which it is associated may be mounted in a separate central vacuum unit.

The master control circuit may be adapted to control the slave control circuits in accordance with a master soft start function to limit instantaneous total inrush current of the vacuum sources. The master control circuit and slave control circuits may be adapted for master slave control using wireless RF communication.

In a second aspect the invention provides a method of operating multiple vacuum sources in a central vacuum cleaning system. The method includes associating a plurality of switches with the vacuum sources. Each switch is associated with a respective one of the vacuum sources. The method also includes controlling the switches using a control circuit to apply power to the vacuum sources.

Controlling the switches using a control circuit may include controlling the switches using a plurality of control circuits with the method further including associating each control circuit with a respective one of the switches. Using a plurality of control switches may include controlling the switches to limit instantaneous total inrush current to the vacuum sources.

Other aspects of the invention will be evident from the principles contained in the description and drawings herein.

BRIEF DESCRIPTION OF THE DRAWINGS

For a better understanding of the present invention and to show more clearly how it may be carried into effect, reference will now be made, by way of example, to the accompanying drawings that show the preferred embodiment of the present invention and in which.

DETAILED DESCRIPTION OF THE PREFERRED EMBODIMENT

Figure 1:
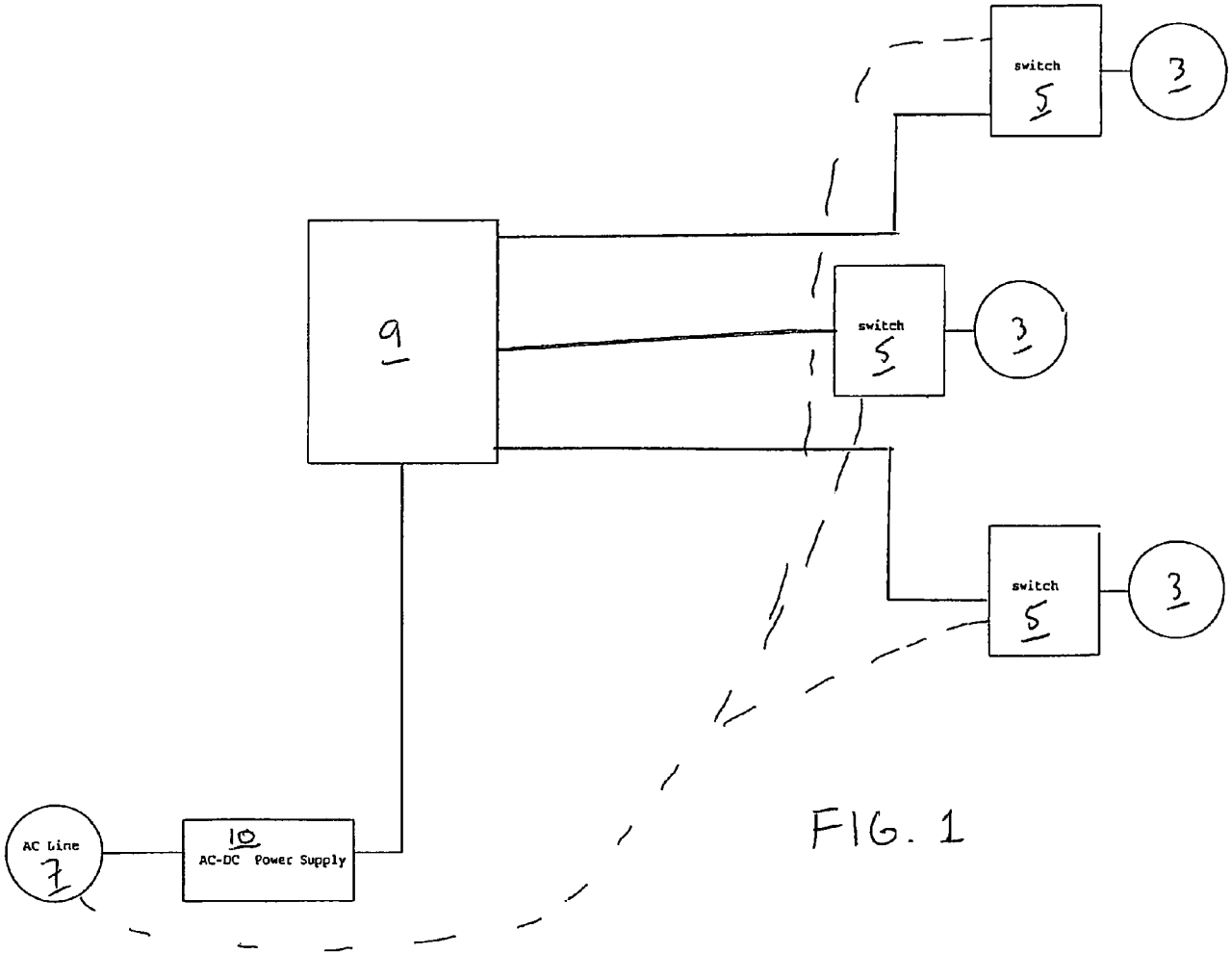
FIG. 1 is a control schematic of a preferred embodiment of a central vacuum cleaning system.
Figure 4:
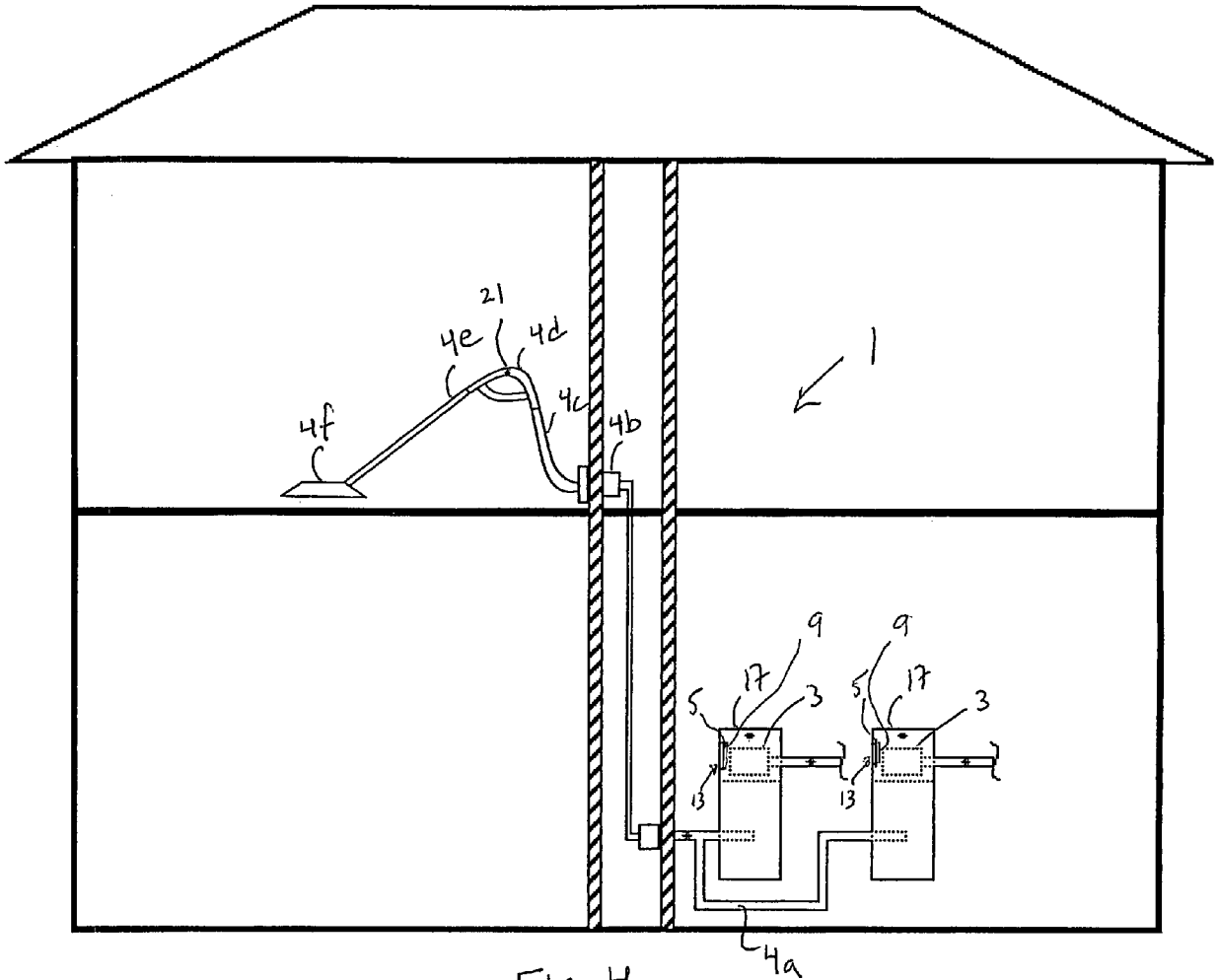
FIG. 4 is a cross-section of a structure incorporating a preferred embodiment of a central vacuum cleaning system.

Referring to FIGS. 1 and 4, a central vacuum cleaning system 1 has multiple vacuum sources 3. The multiple vacuum sources 3 are connected through pipes 4*a* to wall valves 4*b*. In use a hose 4*c* is plugged into one of the valves 4*b*. A handle 4*d* is connected to the hose 4*c*. A wand 4*e* extends from the handle 4*d*. Attachments 4*f* such as a power brush are connected to the wand 4*e*. Switches 5 apply power from one or more power sources 7 to the vacuum sources 3. The application of power by the switches 5 is controlled by a control circuit 9. The control circuit 9 ordinarily operates off low voltage DC while the vacuum source 3 typically operates from AC line voltage. Accordingly an AC-DC power supply 10 is provided for the control circuit 9.

Figure 2:
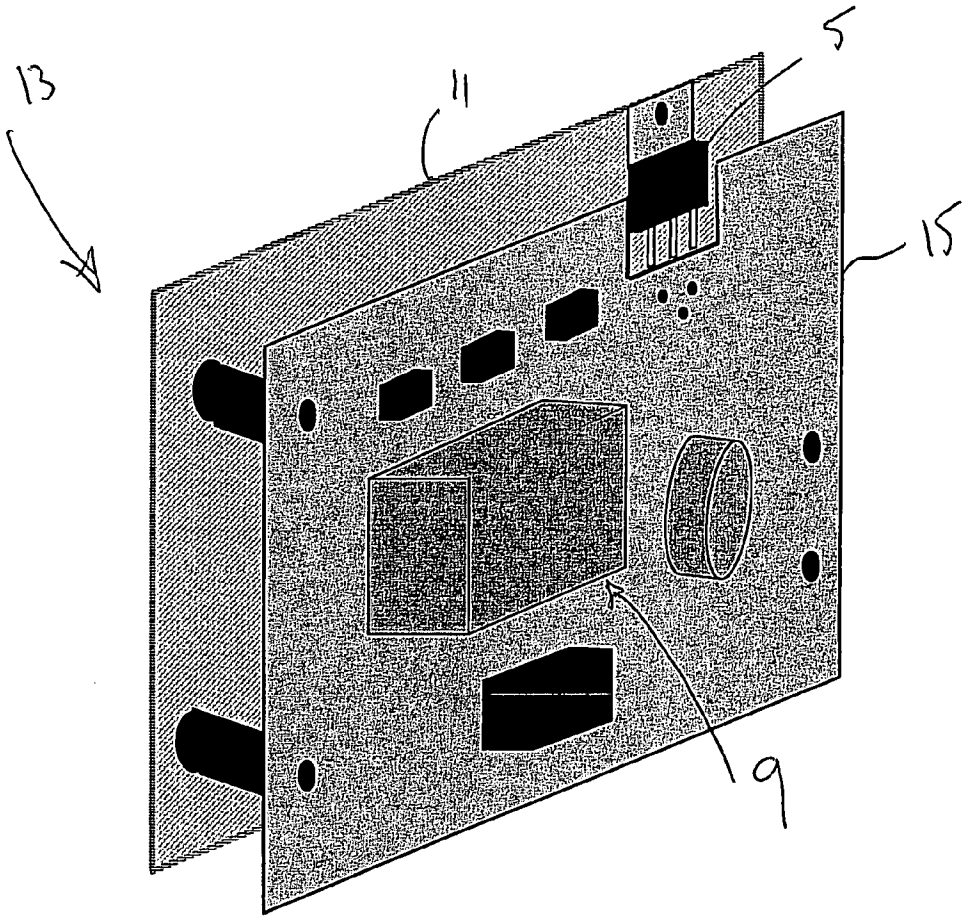
FIG. 2 is a perspective view of a preferred embodiment of a control module for use in the central vacuum cleaning system of FIG. 1.

Referring to FIG. 2, each switch 5 is mounted on a heat sink 11. Each switch 5 is preferably a continuously variable switch 5, such as a solid state triac, that applies a continuously variable amount of power to the vacuum source 3 under the control of the control circuit 9. This allows for such features as variable speed. The control circuit 9 may be made up of discrete components; however, preferably the control circuit 9 will be based on a microcontroller and related circuitry. The various control functions of the microcontroller are implemented through instructions stored in a memory of the microcontroller or a separate memory.

Using multiple vacuum sources can increase the suction of a central vacuum cleaning system. Using multiple switches 5 can avoid heat and power limitations of a single switch implementation for multiple vacuum sources. Use of a single control circuit 9 and multiple switches 5 can minimize the components required to implement a multiple vacuum source cleaning system.

Figure 3:
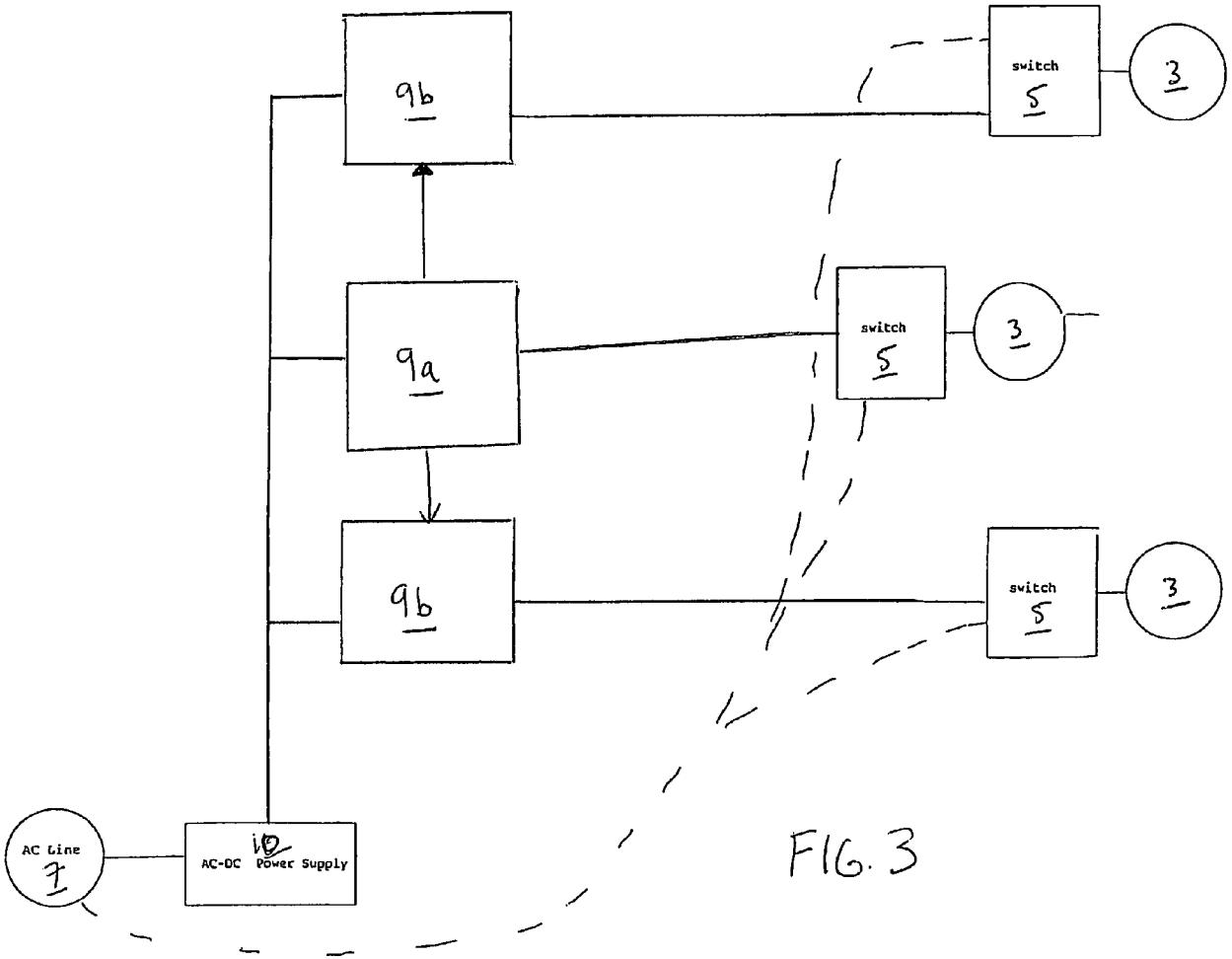
FIG. 3 is a control schematic of a preferred embodiment of a central vacuum cleaning system.

Referring to FIG. 3, each of the switches 5 can be controlled by its own control circuit 9 with one control circuit acting as a master control circuit 9*a* for the other control circuits 9*b*. This allows for manufacture of a single control circuit 9 for either master or slave operation. The designation of master and slave can be easily implemented in many ways, such as for example, through respective DIP switches, not shown, in the control circuit 9.

Referring again to FIG. 2, a switch 5 and a control circuit 9 may be incorporated in a single control module 13. The control module 13 also includes heat sink 11. The control circuit 9 is mounted on a printed circuit board 15. The switch 5 is mounted on the printed circuit board 15 and the heat sink 11.

Referring to FIG. 4, each switch 5 and the vacuum source 3 it controls may be in a separate central vacuum unit 17. As shown in FIG. 4, the switches 5 are part of a control module 13 from the configuration of FIG. 2. The switches 5 could be separately implemented in distinct central vacuum units 17 and controlled from a single control circuit 9 as shown in FIG. 1. Use of multiple control circuits 9 configured in master slave relationships allows each control circuit 9 to utilize its own intelligence for functions such as soft start.

Preferably the master control circuit 9*a* has a master soft start function that allows for coordinated start of the vacuum sources 3. As the vacuum sources 3 are drawing power under the application of multiple switches, it is possible to apply full power to each vacuum source 3. If all sources 3 are started together then the total inrush current can be significant. A master soft start function in the control circuit 9 can be implemented to limit instantaneous total inrush current in different ways. For example, the switches 5 can be controlled to apply power to the vacuum sources 3 one after the other, or to apply less power to each vacuum source 3 while starting multiple vacuum sources 3. A combination of these could also be used.

Communication between the control circuits 9*a*, 9*b* could be implemented using wired or wireless RF communication. Wireless RF communication may be particularly beneficial where respective control circuits 9 are in distinct central vacuum units.

The starting or change in speed of additional vacuum sources 3 could be instigated by a user. For example a control 21 could be provided on the hose handle 4*d* for the user to request more or less suction. This is communicated to the master control circuit 9*a*. Preferably communication from the handle 4*d* to the circuit 4*a* is through wireless RF; however, other wired or wireless communication means may be used.

It will be understood by those skilled in the art that this description is made with reference to the preferred embodiment and that it is possible to make other embodiments employing the principles of the invention which fall within its spirit and scope as defined by the following claims.

I claim:

1. A central vacuum cleaning system comprising:

a) a plurality of vacuum sources connected to provide parallel suction forces, each vacuum source comprising a vacuum motor, b) a control circuit, and c) a plurality of switches, each switch associated with a respective one of the vacuum sources, wherein the control circuit is adapted to control the switches, and each switch is adapted to apply electrical power to its associated vacuum source in accordance with control from the control circuit, and wherein the control circuit is connected independently to each switch and configured to control each switch independently to apply a soft start function in which the application of electrical power to the plurality of vacuum sources is coordinated to limit instantaneous total inrush current of the vacuum sources by a combination of applying power to the vacuum sources one after the other and ramping up power applied to multiple vacuum sources during startup.

2. The system of claim 1 wherein:

the control circuit is a plurality of control circuits and each control circuit is associated with a respective one of the vacuum sources and one of the control circuits is adapted to act as a master control circuit while the remaining control circuits are adapted to act as slave control circuits such that each slave control circuit is adapted to control its associated switch under control of the master control circuit.

3. The system of claim 2 wherein the master control circuit is adapted to control the slave control circuits to implement the soft start function to limit instantaneous total inrush current of the vacuum sources.

4. The system of claim 2 wherein the master control circuit and slave control circuits are adapted for master slave control using wireless RF communication.

5. The system of claim 1 wherein each switch is a continuously variable control switch that is able to apply a continuously variable amount of power.

6. The system of claim 5 wherein each switch comprises a triac.

7. The system of claim 1 wherein each switch is mounted on a distinct heat sink.

8. The system of claim 7 wherein each switch and the vacuum source with which it is associated are mounted in a separate central vacuum unit.

9. A method of operating multiple vacuum sources, each vacuum source comprising a vacuum motor and connected to provide a suction force in parallel with the other vacuum sources, in a central vacuum cleaning system, the method comprises:

associating a plurality of switches with the vacuum sources, each switch associated with a respective one of the vacuum sources; and independently controlling the switches using a control circuit to apply electrical power to the vacuum sources, wherein each switch is controlled independently to coordinate the application of electrical power to the plurality of vacuum sources to limit instantaneous total inrush current of the vacuum sources by a combination of applying power to the vacuum sources one after the other and ramping up power applied to multiple vacuum sources during startup.

10. The method of claim 9 wherein controlling the switches using a control circuit includes controlling the switches using a plurality of control circuits and the method further comprises associating each control circuit with a respective one of the switches.

* * * * *